US010138098B2

(12) United States Patent
Sørensen et al.

(10) Patent No.: US 10,138,098 B2
(45) Date of Patent: Nov. 27, 2018

(54) DRAW-WORKS AND METHOD FOR OPERATING THE SAME

(71) Applicant: NATIONAL OILWELL VARCO NORWAY AS, Kristiansand S (NO)

(72) Inventors: Rune Sørensen, Vedavågen (NO); Timothy Watson, Leduc (CA); Ivan Rajic, Tananger (NO)

(73) Assignee: National Oilwell Varco Norway AS (NO)

( * ) Notice: Subject to any disclaimer, the term of this patent is extended or adjusted under 35 U.S.C. 154(b) by 334 days.

(21) Appl. No.: 15/074,489

(22) Filed: Mar. 18, 2016

(65) Prior Publication Data

US 2016/0289052 A1 Oct. 6, 2016

(30) Foreign Application Priority Data

Mar. 30, 2015 (EP) ..... 15161583

(51) Int. Cl.

| | |
|---|---|
| ***B66D 1/26*** | (2006.01) |
| ***B66D 1/14*** | (2006.01) |
| ***E21B 19/00*** | (2006.01) |
| ***E21B 19/084*** | (2006.01) |

(52) U.S. Cl.

CPC ..... *B66D 1/26* (2013.01); *B66D 1/14* (2013.01); *E21B 19/008* (2013.01); *E21B 19/084* (2013.01)

(58) Field of Classification Search

CPC ... B66D 1/14; B66D 1/16; B66D 1/26; B66D 1/40; B66D 1/44; B66D 1/46; B66D 1/82; E21B 19/008; E21B 19/084

See application file for complete search history.

(56) References Cited

U.S. PATENT DOCUMENTS

| | | | | |
|---|---|---|---|---|
| 3,386,704 | A * | 6/1968 | Dawson | B66D 1/26 254/299 |
| 3,912,229 | A * | 10/1975 | Mitchell | B66D 1/08 254/295 |
| 6,345,724 | B1 * | 2/2002 | Masumoto | B66C 11/20 212/173 |
| 7,270,312 | B1 * | 9/2007 | Phipps | B66D 1/22 254/278 |
| 2006/0197073 | A1 * | 9/2006 | Studer | B66D 1/14 254/278 |
| 2010/0206831 | A1 | 8/2010 | Faust | |

(Continued)

FOREIGN PATENT DOCUMENTS

| | | |
|---|---|---|
| CN | 203382428 | 1/2014 |
| EP | 1178007 | 2/2002 |

OTHER PUBLICATIONS

Extended Search Report for EP 15161583.8 dated Oct. 8, 2015 (10 pages).

*Primary Examiner* — Emmanuel M Marcelo
(74) *Attorney, Agent, or Firm* — Conley Rose, P.C.

(57) ABSTRACT

Disclosed is a draw-works and a method of operation. The draw-works includes a first drum configured to store and reel in an elongated hoisting member, such as a hoisting cable, a second drum configured to store and reel in the elongated hoisting member, and a rotation device configured to rotate the first and second drums, wherein at least one of the drums is selectively connectable to and disconnectable from the rotation device.

20 Claims, 4 Drawing Sheets

(56) References Cited

U.S. PATENT DOCUMENTS

| | | | | |
|---|---|---|---|---|
| 2010/0224844 | A1* | 9/2010 | Boussaton | B66D 1/26 254/290 |
| 2011/0127477 | A1* | 6/2011 | Kokolis | B66C 13/16 254/285 |
| 2013/0026431 | A1* | 1/2013 | Uemura | B66C 23/44 254/325 |
| 2014/0199152 | A1* | 7/2014 | Roodenburg | B66D 1/7405 414/800 |
| 2015/0375975 | A1* | 12/2015 | Flateland | B66D 1/7405 254/310 |

* cited by examiner

6

DRAW-WORKS AND METHOD FOR OPERATING THE SAME

CROSS-REFERENCE TO RELATED APPLICATIONS

This application claims priority to European Patent Application No. 15161583.8 having the International Filing date of Mar. 30, 2015 and entitled "Draw-Works and Method for Operating the Same," which is hereby incorporated herein by reference in its entirety for all purposes.

STATEMENT REGARDING FEDERALLY SPONSORED RESEARCH OR DEVELOPMENT

Not applicable

BACKGROUND

The present disclosure relates to a draw-works. More specifically the disclosure relates to a draw-works comprising a first drum for storing and reeling an elongated hoisting member, a second drum for storing and reeling the elongated hoisting member and a rotation means for rotating the first and second drums. The disclosure also relates to a method for operating a draw-works.

A draw-works is the primary hoisting machinery that is a component of a drilling rig. Its main function is to provide a means of raising and lowering the travelling blocks, the travelling blocks further being connected to load suspension members. The wire-rope drilling line winds on the draw-work's drum and extends to the crown block and travelling blocks, allowing the drill string to be moved up and down as the drum turns. The segment of drilling line from the draw-works to the crown block is called the "fast line". The drilling line then enters the sheaves of the crown block and makes several passes between the crown block and travelling block pulleys for mechanical advantage. The line then exits the last sheave on the crown block and is usually fastened to a derrick leg on the other side of the rig floor. This section of drilling line is called the "dead line".

The term "draw-works" is often used interchangeably with "winch" to define the machinery in a hoisting system. Herein "draw-works" shall be taken to mean any hoisting machinery adapted to store and reel a wire rope or another elongated hoisting members, both as used on drilling rigs and in other hoisting operations such as with lifting cranes.

In the late 90's, draw-works including active heave compensation means became commercially available. The active heave compensated draw-works were AC-driven and featured single-speed, single-shaft, direct gear drive and a plurality of AC motors.

More recently, dual heave compensated draw-works have been introduced where one draw-works is placed on each side of the derrick, implying that the "dead line" is not fixed to the derrick or to the rig floor, but rather to another draw-works powered from an independent source. The dual draw-works offers the advantage of increased speed, as the wire rope may be reeled from both draw-works simultaneously, thus essentially doubling the speed of the travelling block. Moreover, the dual draw-works also offers the advantage of redundancy, in case one of the draw-works should fail, as well as simplified replacement of worn wire rope, so-called line exchange, as the wire rope may be reeled from one winch drum, over the pulley and to the second winch drum. Dual draw-works has the disadvantage of leaving a large footprint as a draw-works is placed on each side of the derrick, the available space often being limited on rig floors.

The requirements for hoisting capacity in terms of weight for draw-works, including for heave-compensated draw-works, are getting increasingly large, and the draw-works need to be dimensioned accordingly. Often it is the hoisting of casings or heavy blow-out preventers (BOPS) that sets the design load for the draw-works. At the same time, there is a strong desire to increase hoisting speed, particularly for increasing tripping speed, i.e. to reduce the time for pulling the drill string out of the hole or replacing it in the hole, which is the process in which a typical draw-works will be most frequently involved. This problem could be solved by doubling the motor capacity on one or both of the draw-works in a conventional dual draw-works system, but that would significantly increase the cost and weight of the system which already leaves a very large footprint.

BRIEF SUMMARY OF THE DISCLOSURE

The disclosure presents a means aimed toward reducing at least one of the drawbacks of the prior art, or at least provide a useful alternative to prior art using features which are described below. The invention is defined in the claims that follow the description.

In a first aspect, the disclosure relates to a draw-works comprising:

- a first drum for storing and reeling an elongated hoisting member;
- a second drum for storing and reeling said elongated hoisting member; and
- a rotation means for rotating said first drum and said second drum; wherein:
  - at least one of said first drum and said second drum is selectively connectable to and disconnectable from said rotation means.

The disclosure, in its broadest form according to the first aspect, solves the challenge with the trade-off between hoisting weight and speed capacity. The elongated hoisting member, which typically will be a wire rope of some sort, may be reeled from one or both of the drums. By disconnecting/unlocking one of the drums from the rotation means, all torque from the rotation means will be available for the other one of the drums. This operation mode may be used when lifting particularly heavy weights, such as casing strings or BOPs, where hoisting speed is not of the essence. By connecting both drums to the rotation means, the available torque will be shared between the two drums, while the line speed, as seen from a travelling block, will be substantially doubled compared to the mode where all torque is available for one drum. This latter mode may be particularly useful in tripping and other operations where speed is of the essence, but where the load is less heavy. As such, a draw-works according to this arrangement may thus provide the advantage of increased speed, as also seen in the dual draw-works according to the prior art, while at the same time offering maximum torque, as typically found in single draw-works while at the same time not having to double the motor capacity. The draw-works according to this arrangement may thus also be regarded as comprising a simple and rather in-expensive 2:1 transmission.

In one embodiment, the at least one of said first drum and said second drum may be selectively connectable to and disconnectable from said rotation means by means of a remotely operateable connection, such as a remotely operateable spline connection. In alternative embodiments, the connection may be realized in terms other mechanical connections/couplings, such as locking dogs, locking claws, a friction coupling or of a combination of these. The couplings/connections may be remotely operateable. This has the great advantage of the draw-works being able to switch remotely and quickly between the two modes mentioned above, i.e. driving both drums or driving only one drum. The remote operation may be implemented by means of an actuator which may be electric, hydraulic or pneumatic. The switching may be done manually or automatically by means of a control unit. Typically the drums will be suspended around a rotatable shaft by means of a set of bearings. When the connection/coupling is activated/engaged, the drum will rotate with the shaft, whereas when the connection is dis-engaged the shaft may rotate freely inside the drum in the bearings. In one embodiment, a drum which has been disconnected from the rotation means, typically from the shaft as described above, may be locked to supporting structure of the drum, typically to a drum housing/draw-works skid frame, to ensure that it does not rotate with the shaft. The locking may be done by means of a draw-works braking means, which may be implemented as conventional disc brakes or band brakes as will be understood by a person skilled in the art.

In one embodiment, the rotation means may comprise a first rotation means for rotating the first drum and a second rotation means for rotating the second drum, said first and second rotation means being selectively, mechanically connectable and disconnectable from each other. This opens up for yet another operation mode, namely a mode where the drums are operated independently of each other as will be described in the following.

Said first rotation means may comprise one or more motors, gears and a first rotatable shaft, and said second rotation means may comprise one or more motors, gears and a second rotatable shaft, and wherein said first rotatable shaft may be selectively, mechanically connectable to and disconnectable from said second rotatable shaft. Typically each rotation means will comprise a plurality of AC motors rotating a shaft via a gearing means. By allowing the shaft of the rotation means to be split into two, i.e. to disconnect/unlock the first shaft from the second shaft, the two drums, each having one or more motors, may be operated independently, which may be beneficial for redundancy and/or for line exchange operations. The first and second shafts may subsequently be connected again to run the shaft as one with the combined torque from the motors from both sides. In one embodiment, said first rotatable shaft may be selectively, mechanically connectable to and disconnectable from said second rotatable shaft by means of a remotely operateable connection, such as a remotely operateable spline connection. In other embodiments, the connection may be realized in terms of other mechanical connections, such as locking dogs, locking claws, a friction coupling or a of combination of these, all preferably remotely operateable. The remote operation may be implemented by means of actuator which may be electric, hydraulic or pneumatic. As described above for the drum's connection to and disconnection from the shaft/rotation means, the remote operation may allow for a quick switch between various modes of operation of the draw-works described herein. When the first and second shafts are disconnected, the two drums may be operated independently, as with the dual draw-works according to the prior art.

It should be noted that the drum shafts do not necessarily have to be axial aligned, but may be slightly offset with a 1:1 gear in between, though an embodiment where the shafts are axially aligned and only connected by one of the above-mentioned connections/couplings will probably be most relevant.

In one embodiment, the draw-works may further comprise a heave compensation means. A person skilled in the art will understand that the motion, typically due to wind and sea, of the vessel/platform on which the draw-works is placed, may be counteracted by a heave compensation means so as to keep a load at a position substantially fixed relative to the sea-bed or to move a load at a substantially predetermined speed relative to the sea-bed. The heave compensation means includes a control unit comprising one or more motion reference units (MRUs) for sensing and calculating the vessel's/platform's motion and for operating the winch drum to reel out or in wire rope so as to substantially counteract the motion.

The disclosure also relates to a hoisting system comprising a draw-works according to the description previously provided. The hoisting system will typically also comprise an elongated hoisting member, such as a wire rope, a number a sheaves, some of which are included in a crown block and a travelling block and some of which are for guiding the elongated hoisting member from the draw-works to the crown and travelling blocks and back to the draw-works. Further, the hoisting system will comprises a control unit for electronically controlling the rotation of the drums.

A drilling rig comprising a hoisting system including a draw-works according to the first aspect of the disclosure is also disclosed herein.

In a second aspect, the disclosure relates to a method for operating a draw-works previously described, wherein the method comprises the step of:

connecting both said first drum and said second drum to said rotation means, so as to rotate the two drums synchronously. This step may be described as running the draw-works in a dual mode/fast mode, such as may preferably be used in tripping.

In one embodiment, the method may further comprise the step of:

disconnecting one of said first drum and said second drum from said rotation means so as to only rotate one of the drums. This step may be described as running the draw-works in torque mode/single mode, as the torque of both rotation means is combined in one drum. This will be particularly useful for lifting heavy loads and/or when speed is less important.

In particular, the disclosure relates to switching between the two modes where either one or both drums are connected to the rotation means. The switching may preferably be done remotely.

Finally, the method may further comprise the step of disconnecting a first rotation means for rotating said first drum from a second rotation means for rotating said second drum so as to operate said first and second drums independently, the advantage of which was already described above. This latter mode of operation may be described as an independent mode. As also described above, the connection and disconnection may be realized by connecting and disconnecting a first and second shaft to and from each other, preferably by means of a spline connection, or other types of connections mentioned above, and further preferably remotely. The disclosure thus also relates to switching between the three modes of operations described herein; dual mode, single mode and independent mode.

BRIEF DESCRIPTION OF THE DRAWINGS

The following describes exemplary embodiments illustrated in the accompanying drawings, wherein.

DETAILED DESCRIPTION OF EXEMPLARY EMBODIMENTS

Figure 1:
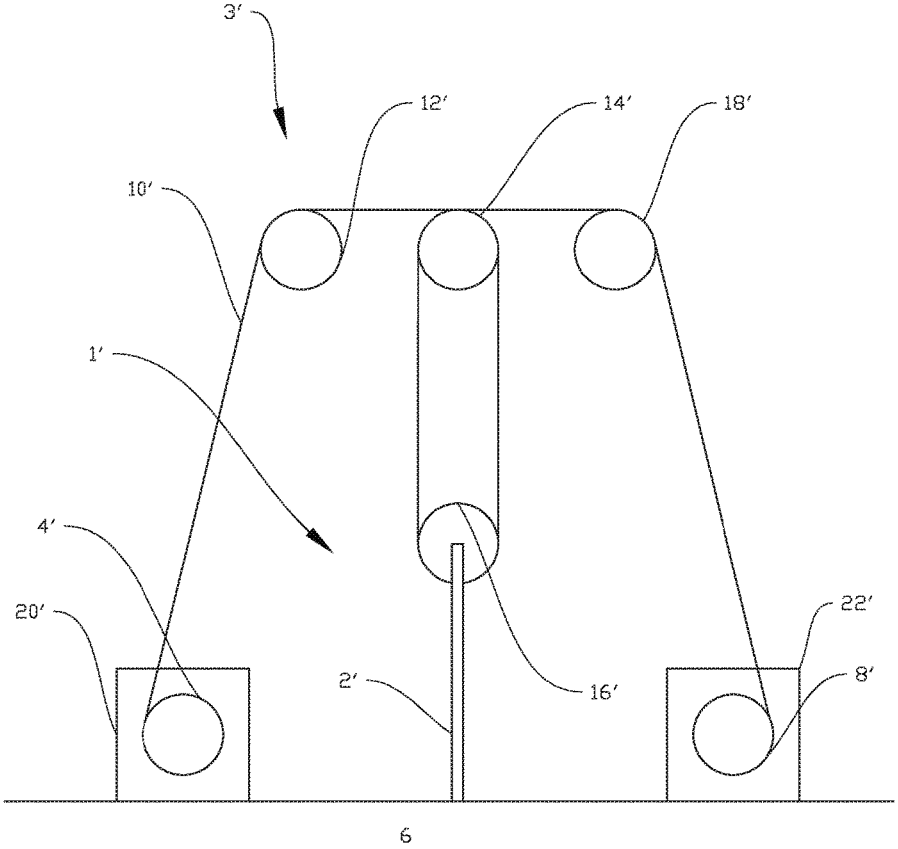
Fig. 1 (PRIOR ART)
FIG. 1 shows, in a schematic side view, a hoisting system including a draw-works according to the prior art.

In the following, the reference numeral 1 will indicate a draw-works according to the present disclosure, whereas the reference numeral 1' indicates a draw-works according to the prior art. Identical reference numerals will indicate identical or similar features in the drawings. The figures are shown schematically and simplified and various features in the figures are not necessarily drawn to scale.

FIG. 1 shows a prior art hoisting system 3' with a dual draw-works 1' according to the prior art. An elongated hoisting member 10' in the form of a wire rope is stored and reeled from a first drum 4' placed on the left hand side of a derrick 6' and a second drum 8' placed on the right hand side of the derrick 6'. The wire rope 10', is reeled from the first drum 4' to the second drum 8', over a first guiding sheave 12' to a crown block 14' down to a travelling block 16', where the wire rope 10' makes several turns about the crown block 14' and travelling block 16' to generate the desired mechanical advantage. The wire rope 10' leaves the crown block 14' and runs over a second guiding sheave 18' before it enters the second drum 8'. The first drum 4' is rotatable by means of a first, not shown, rotation means, whereas the second drum 8' is rotatable by means of a second, not shown, rotation means. A load 2' in the form of a pipe string is shown suspended from the travelling block 16'. The rotation means will typically include a plurality of AC motors adapted to rotate a shaft to which the drums 4', 8' are connected. The first drum 4' is placed partially within a first housing 20' while the second drum 8' is placed partially within a second housing 22'. The reeling operation of the drums 4', 8' is controlled by a not shown control unit including a motion reference unit. However, a description of the relatively complicated rotational motion of the drums 4', 8' particularly when aiming at counteracting the ship's heave, is beyond the scope of the present description and will not be discussed more in detail herein. This draw-works 1' according to the prior art offers the advantages, over a single draw-works system, of increased hoisting speed, redundancy and simplified line exchange for replacement of the wire rope 10'.

Figure 2:
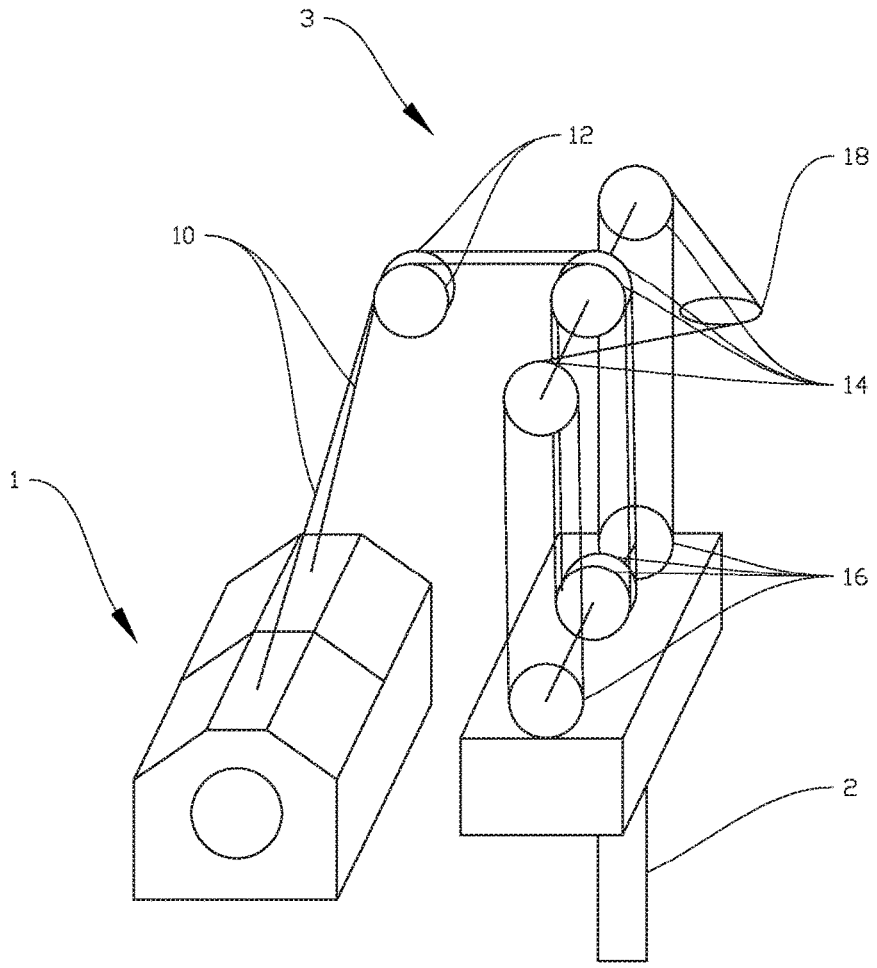
FIG. 2 shows, in schematic, perspective view, a hoisting system including a draw-works according to the present disclosure.
Figure 3:
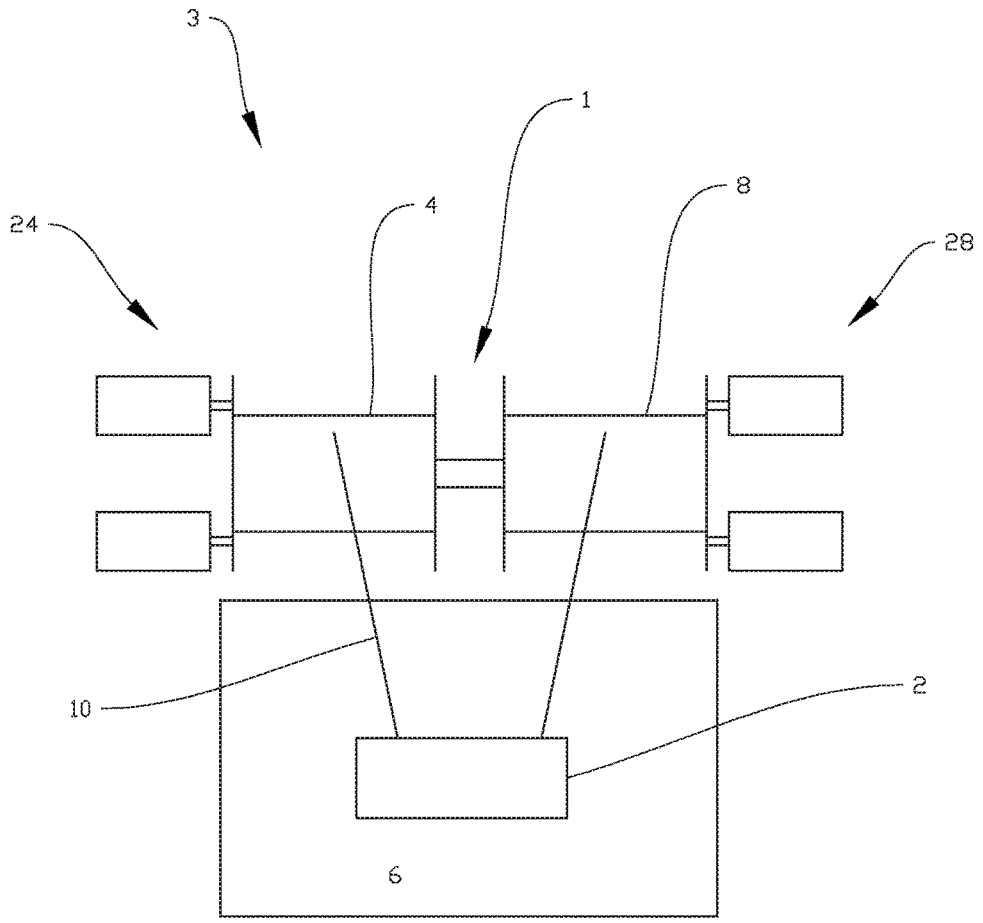
FIG. 3 shows, in a schematic top view, a hoisting system including a draw-works according to the present disclosure.

FIG. 2 shows a hoisting system 3 with a draw-works 1 according to the present disclosure placed in a derrick 6 (FIG. 3). As described above, the draw-works 1 according to the present disclosure may be regarded as a combined single and dual draw-works. It may also, in the shown embodiment, be run as two separate, independent draw-works placed adjacent to each other on the same side of the derrick 6, or it may be run as a single draw-works with two different modes, one for maximum torque and the other for increased speed as will be described in more detail below. It should be noted that there are many ways to string a wire rope 10 in a hoisting system wherein a draw-works 1 according to the present disclosure is included. Since both drums 4, 8 are provided on the same side of the derrick 6, it may involve a flip of the bending of the wire rope 10 from one of the drums 4, 8, but it does not have to. The direction of the wire rope 10 may also be changed gradually between the various sheaves in the system, as will be understood by a person skilled in the art, and therefore will not be described more in detail herein. The sheave arrangement is only shown very simplified in FIG. 2.

In the perspective view of FIG. 2, it can be seen the both ends of the wire rope 10 are connected to the draw-works 1 on one side of the derrick 6. The duality can be seen in the figure as the wire rope 10 runs over a first pair of guiding sheaves 12, before it enters a crown block 14, and runs down to a travelling block 16 connected to a load 2, here schematically indicated as a top drive and a pipe string before it runs back to the draw-works 1.The wire rope 10 also runs over a guiding sheave 18, which in the figure is shown laying in a horizontal plane in order indicate the stringing of the wire rope 10 back to the same side of the derrick 6. Crossing of the wire rope 10 between the various sheaves of the crown block 14 and travelling block 16 is not shown in the figure. As mentioned above, a person skilled in the art would understand that the wire rope may be strung in a number of different ways, and this is not described in further detail herein.

FIG. 3 shows, in a very simplified manner, the derrick 6 with the draw-works 1 as seen from above. Here the draw-works 1 is shown in slightly more detail, and a first drum 4 can be seen connected to a second drum 8, each drum 4, 8 being connected to a rotation means 24, 28, respectively. The wire rope 10 runs from both drums 4, 8 into the derrick 6, where it is connected to a load 2. The sheave arrangements are not shown in this figure for simplicity.

Figure 4:
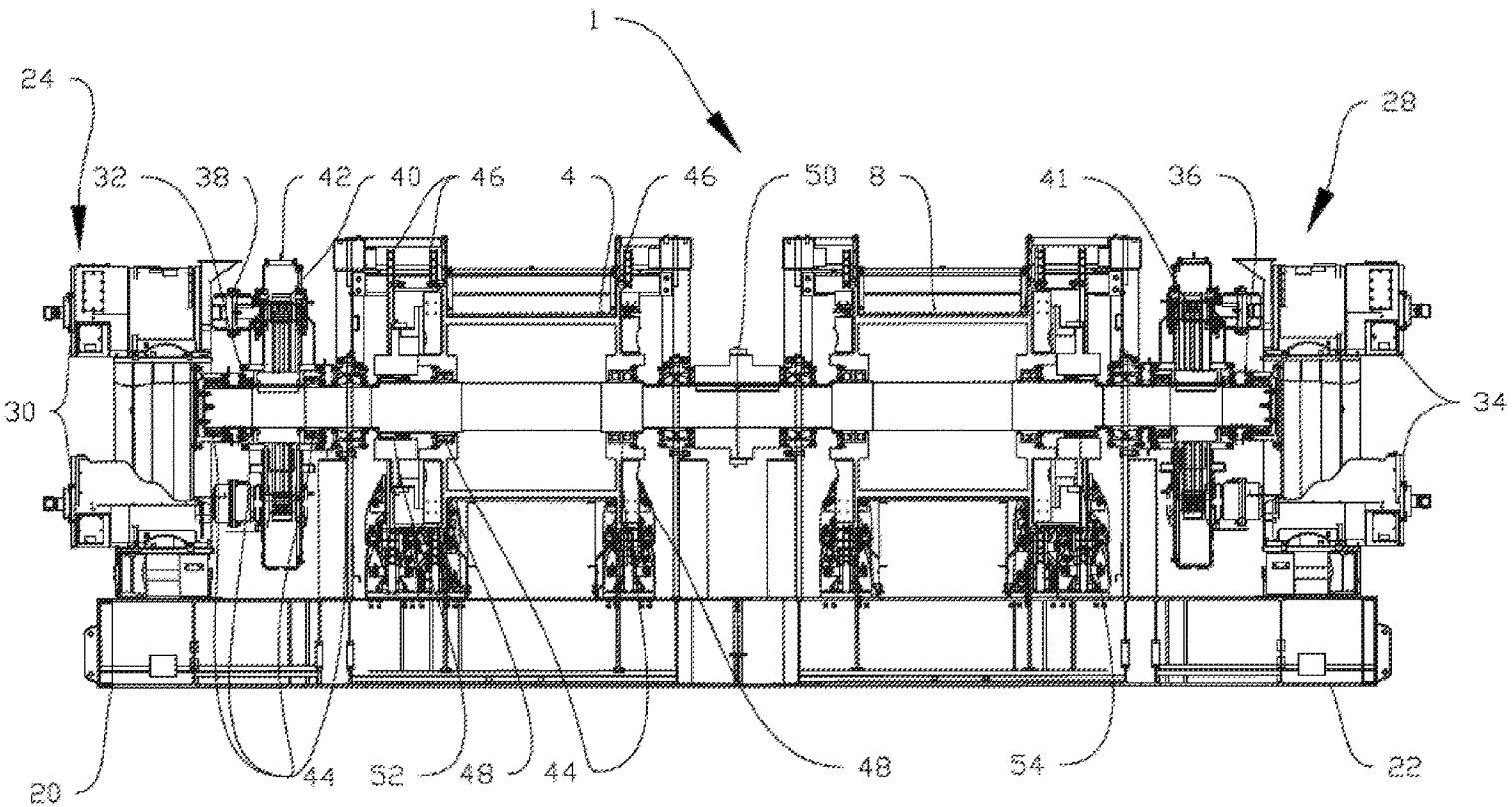
FIG. 4 shows, in a detailed front view, a draw-works according to the present disclosure.

FIG. 4 is a more detailed view of one embodiment of a draw-works 1 according to the present disclosure. The draw-works includes a first drum 4 and a second drum 8, rotatable by a first rotation means 24 and a second rotation means 28, respectively, the first rotation means 24 comprising three AC motors 30, of which only two are visible in the figure, gear 40 and a first shaft 32. Similarly the second rotation means 28 comprises three AC motors 34, of which only two are visible in the figure, gear 41 and a second shaft 36. The two sides of the draw-works 1 are substantially identical, hence only the left hand side, including the first drum 4, will be described in detail in the following. Each of the AC motors 30 are connected to the shaft 32 via a motor coupling 38 and the gear 40, the gear 40 being placed within a gear case 42. The shaft 32 is provided with a plurality of shaft bearings 44, while braking functionality is ensured by brake discs 46 and callipers 48. In the shown embodiment, the first shaft 32 and the second shaft 36 are connected in a shaft connection 50. The shaft connection 50 is, in the shown embodiment, a remotely operateable spline connection, not shown in detail, which enables the two shafts 32, 36, and thereby the two rotation means 24, 28 to be selectively, mechanically connected to and disconnected from each other, implying that the torque from the first set of AC motors 30 may be combined with the torque from the second set of AC motors 34 when the two shafts 32, 36 are connected. Other possible shaft connections 50 were discussed in the general part of the description.

In addition to the shafts 32, 36 being selectively connectable to and disconnectable from each other, also the first and second drums 4, 8 are disconnectable from and connectable to the first and second shafts 32, 36, respectively. The first drum 4 is selectively connectable to and disconnectable from the rotating motion of the rotatable first shaft 32 by means of a connection 52, in the form of a remotely operateable spline connection. Similarly, the second drum 8 is selectively connectable to and disconnectable from the rotating motion of the rotatable second shaft 36 by means of a connection 54, also in the form of a remotely operateable spline connection. Other possible connections for the drums 4,8 to their respective shafts 32, 36 were discussed in the general part of the description. By means of the brake discs 46 and callipers 48 it may also be possible to lock the drums 4, 8 to their respective drum housings 20, 22 when they are disconnected from their respective shafts 32, 36 so as to ensure that the drums 4, 8 do not rotate unintentionally. Other types of brakes, such as band brakes, may also be used. It should be noted that it will normally make no sense to disconnect both drums 4, 8 from the shafts 32, 36 at the same time.

Possible modes of operation with a draw-works according to the description above may be summarized as follows:

Dual mode: Both drums 4, 8 are connected/locked to their respective shafts 32, 36 and the two shafts 32, 36 are connected/locked to each other. The torque from the AC motors 30, 34 from both sides is combined to rotate both drums 4, 8 which are run synchronously. This mode of operation will substantially double the hoisting speed as seen from the travelling block 16 compared to a single draw-works with the same maximum rotation speed of the drum. As described above, this dual mode may be particularly beneficial to use during tripping due to reduced operation time.

Single mode: One of the drums 4, 8 is disconnected/unlocked from its respective shaft 32, 36, the other one of the drums 4, 8 is connected/locked to its respective shaft 32, 36, while the two shafts 32, 36 are still connected/locked together. The torque from the AC motors 30, 34 will thus be combined to rotate one of the drums 6, 8, substantially doubling the torque transfer to the one drum, while substantially halving the hoisting speed compared to dual mode. This single mode may be beneficial to use when lifting particularly heavy loads, such as casing strings and BOPs.

Independent mode: Both drums 4, 8 are connected/locked to their respective shafts 32, 36 while the two shafts are disconnected/unlocked from each other. This implies that both drums 4, 8 are run independently with its own set of AC motors 30, 34 with no transfer of torque between the two sides. This mode of operation substantially resembles the dual draw-work 1' according to the prior art discussed above with reference to FIG. 1, with the difference that both drums 4, 8 are provided on the same side of the derrick 6. It should also be noted that the drums 4, 8 may be rotated synchronously in independent mode, the synchronization then being ensured electronically by means of a not shown control unit. This may be particularly useful in so-called "fixed-to-bottom" active heave-compensated operations. If one of the sets of AC motors 30, 34 should fail, the failed set of motor sets 30, 34 and the appurtenant drum 4, 8 may be shut down while the heave compensation seamlessly is taken over by then other set of AC motors 30, 34 and the other drum 4, 8.

It should be noted that the above-mentioned embodiments illustrate rather than limit the invention, and that those skilled in the art will be able to design many alternative embodiments without departing from the scope of the appended claims. Use of the verb "comprise" and its conjugations is used in the open-ended sense and does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

What is claimed is:

1. A draw-works comprising:

an elongated hoisting member having a first end and a second end, a first drum for storing and reeling an elongated hoisting member;

a second drum for storing and reeling said elongated hoisting member; and a rotation assembly for rotating said first drum and said second drum;

wherein at least one of said first drum and said second drum is selectively connectable to and disconnectable from said rotation assembly; and wherein the first end of said elongated hoisting members is connected to said first drum, and the second end of said elongated hoisting member is connected to said second drum.

2. The draw-works according to claim 1, wherein the at least one of said first drum and said second drum is selectively connectable to and disconnectable from said rotation assembly by means of a first remotely operateable connection.

3. The draw-works according to claim 2 wherein said first remotely operateable connection is a remotely operateable spline connection.

4. The draw-works according to claim 3, wherein the at least one of said first drum and said second drum is lockable to a draw-works support structure when the at least one of said first drum and said second drum is disconnected from said rotation assembly.

5. The draw-works according to claim 2 wherein:

said rotation assembly comprises a first rotation assembly for rotating said first drum and a second rotation assembly for rotating said second drum, said first and second rotation assembly being selectively, mechanically connectable to and disconnectable from each other; and said first rotation assembly comprises one or more motors and a first rotatable shaft, wherein said second rotation assembly comprises one or more motors and a second rotatable shaft, and wherein said first rotatable shaft is selectively, mechanically connectable to and disconnectable from said second rotatable shaft.

6. The draw-works according to claim 5, wherein said first rotatable shaft is selectively, mechanically connectable to and disconnectable from said second rotatable shaft by means of a second remotely operateable connection.

7. A draw-works comprising:

a first drum for storing and reeling an elongated hoisting member;

a second drum for storing and reeling said elongated hoisting member; and a rotation assembly for rotating said first drum and said second drum;

wherein at least one of said first drum and said second drum is selectively connected to and disconnectable from said rotation assembly;

wherein the at least one of said first drum and said second drum is selectively connectable to and disconnectable from said rotation assembly by means of first remotely operateable connection;

wherein said rotation assembly comprises a first rotation assembly for rotating said first drum and a second rotation assembly for rotating said second drum, said first and second rotation assembly being selectively, mechanically connectable to and disconnectable from each other.

8. The draw-works according to claim 7, wherein said first rotation assembly comprises one or more motors and a first rotatable shaft, wherein said second rotation assembly comprises one or more motors and a second rotatable shaft, and wherein said first rotatable shaft is selectively, mechanically connectable to and disconnectable from said second rotatable shaft.

9. The draw-works according to claim 8, wherein said first rotatable shaft is selectively, mechanically connectable to and disconnectable from said second rotatable shaft by means of a second remotely operateable connection.

10. The draw-works according to claim 9 wherein said second remotely operateable connection is a remotely operateable spline connection.

11. The draw-works according to claim 8 wherein said first drum is suspended on said first rotatable shaft on a plurality of bearings and wherein said second drum is suspended on said second rotatable shaft on a plurality of bearings.

12. The draw-works according to claim 7, wherein the draw-works further comprises a heave compensation means.

13. A draw-works comprising:

a hoisting cable having first and second ends;

a first drum configured to store said first end of said hoisting cable and to reel in said hoisting cable when said first drum is rotated;

a second drum configured to store said second end of said hoisting cable and to reel in said hoisting cable when said second drum is rotated;

a first rotation assembly configured to rotate said first drum and comprising one or more motors coupled to a first rotatable shaft;

a second rotation assembly configured to rotate said second drum and comprising one or more motors coupled to a second rotatable shaft;

wherein at least said first drum is selectively connectable to and disconnectable from said first rotatable shaft.

14. The draw-works of claim 13 wherein said first and second rotation assembly is configured to be selectively, mechanically connectable to and disconnectable from each other.

15. The draw-works of claim 14 wherein said first rotatable shaft is selectively, mechanically connectable to and disconnectable from said second rotatable shaft.

16. The draw-works of claim 13 wherein at least said first drum is selectively connectable to and disconnectable from said first rotatable shaft by means of a remotely operateable spline connection.

17. A method for operating a draw-works wherein the draw-works comprises:

a first drum configured to store and reel in an elongated hoisting member;

a second drum configured to store and reel in said elongated hoisting member; and a rotation assembly configured to rotate said first drum and said second drum;

wherein at least one of said first drum and said second drum is selectively connectable to and disconnectable from said rotation assembly;

wherein said rotation assembly comprises a first rotation assembly for rotating said first drum and second rotation assembly for rotating said second drum, said first and second rotation assembly being selectively, mechanically connectable to and disconnectable from each other;

wherein the method comprises:

connecting both said first drum and said second drum to said rotation assembly so as to rotate the two drums synchronously.

18. The method according to claim 17, wherein the method further comprises:

disconnecting one of said first drum and said second drum from said rotation assembly so as to only rotate one of the drums.

19. The method according to claim 18, wherein the method further comprises switching between a mode where both said first drum and said second drum are connected to said rotation assembly, and a mode where only one of said first drum and said second drum is connected to said rotation assembly.

20. A method for operating a draw-works wherein the draw-works comprises:

a first drum configured to store and reel in an elongated hoisting member;

a second drum configured to store and reel in said elongated hoisting member; and a rotation assembly configured to rotate said first drum and said second drum;

wherein at least on of said drum and second said drum is selectively connectable to and disconnectable from said rotation assembly;

wherein the method comprises;

connecting both said and first drum and second drum to said rotation assembly so as to rotate the two drums synchronously; and disconnecting a first rotation assembly that is configured to rotate said first drum from a second rotation assembly that is configured to rotate said second drum so as to operate said first and second drums independently.

* * * * *